US005324022A

United States Patent [19]

Quackenbush et al.

[11] Patent Number: 5,324,022

[45] Date of Patent: Jun. 28, 1994

[54] TANDEM FRUSTO-CONICAL ROLLER MECHANISM FOR RECEIVER MEMBER EDGE REGISTRATION

[75] Inventors: Raymond M. Quackenbush, Hilton; Robert A. Zimny, Brockport; Steven P. Bailey; Michael Kenin, both of Rochester, all of N.Y.

[73] Assignee: Eastman Kodak Company, Rochester, N.Y.

[21] Appl. No.: 976,590

[22] Filed: Nov. 16, 1992

[51] Int. Cl.[5] ..... B65H 9/16

[52] U.S. Cl. ..... 271/250

[58] Field of Search ..... 271/250, 251

[56] References Cited

U.S. PATENT DOCUMENTS

| | | | |
|---|---|---|---|
| 3,122,935 | 3/1964 | Morling | 74/241 |
| 3,709,596 | 1/1973 | Ulmer | 355/109 |
| 3,854,315 | 12/1974 | Winkler | 271/250 X |
| 3,929,327 | 12/1975 | Olson | 271/250 |
| 3,954,261 | 5/1976 | Greene et al. | 271/188 |
| 4,068,789 | 1/1978 | Young, Jr. et al. | 226/3 |
| 4,140,216 | 2/1979 | Conrad | 198/835 |
| 4,188,025 | 2/1980 | Gusfafson et al. | 271/314 |
| 4,421,228 | 12/1983 | Marsiglio et al. | 198/814 |
| 4,629,177 | 12/1986 | Roddeman et al. | 271/240 |
| 4,832,186 | 5/1989 | Conrad | 198/840 |
| 4,955,965 | 9/1990 | Mandel | 271/225 |
| 5,069,442 | 12/1991 | Storz | 271/250 |

OTHER PUBLICATIONS

IBM Technical Disclosure Bulletin, vol. 19 No. 3 pp. 1031, 1032, Aug. 1976, "Controlled Skew Feed Roll Shaft", N. F. Cole and G. C. Matuck.

IBM Technical Disclosure Bulletin vol. 25 No. 10 p. 5138, Mar. 1983 Cone Roller Couple, E. B. Kroeker.

*Primary Examiner*—Richard A. Schacher

*Attorney, Agent, or Firm*—Lawrence P. Kessler

[57] ABSTRACT

In an apparatus for transporting sheets along a travel path, a registration mechanism for aligning a sheet relative to the travel path. The registration mechanism comprises a support for a sheet moving along the travel path and a pair of frusto-conical rollers. The frusto-conical rollers are mounted for rotation about common axis, with the apex portions of the respective frusto-conical rollers oriented in the same direction relative to the common axis. The common axis is located to lie in a plane parallel to the plane of a sheet in the travel path and extend in a direction transverse to the direction of movement of a sheet along the travel path. The plane containing the axis is spaced from the sheet supporting means a distance such that the frusto-conical rollers are in nip relation with the sheet supporting means so as to urge a sheet in the travel path in the direction of movement along the travel path and in a direction transverse to the direction of movement with a minimum of skew induced in such sheet.

2 Claims, 3 Drawing Sheets

TANDEM FRUSTO-CONICAL ROLLER MECHANISM FOR RECEIVER MEMBER EDGE REGISTRATION

BACKGROUND OF THE INVENTION

The present invention relates in general to registration mechanisms for sheet transport apparatus, and more particularly, to a registration mechanism employing a pair of tandem frusto-conical rollers for effecting edge registration of a transported sheet.

In modern reproduction apparatus, such as printers or copiers or the like, information is reproduced on receiver members such as cut sheets of paper for example. Typically the receiver members are transported seriatim along a path and registered in the path so as to be located to receive a developed image-wise-pattern corresponding to the information to be reproduced. The developed image-wise pattern is transferred to the receiver member and fixed thereto to form the desired reproduction. The particular registration of the receiver member with the developed image-wise pattern is critical in forming an acceptable reproduction. In view of the accuracy of registration required in certain reproduction apparatus, it has been found necessary to provide for both in-track and cross-track alignment.

Registration apparatus which provide for cross-track alignment by the use of a frusto-conical roller are well known; see for example, U.S. Pat. No. 3,929,327, issued Dec. 30, 1975, in the name of Olson. As described in the above patent, the radial deformation of the frusto-conical roller exerts forces on a transported sheet to urge the sheet in the transport (in-track) direction as well as to provide a torque on the sheet to rotate the sheet into engagement with an elongated lateral registration edge. Continued transport of the sheet then causes the sheet to become aligned, in a direction transverse (cross-track) to the transport direction, against the elongated lateral registration edge. However, this arrangement requires substantial movement of the sheet in the transport direction before cross-track alignment is completed. In a reproduction apparatus operating at a relatively high speed with a short sheet travel path, there may not be enough travel distance to assure the desired cross-track alignment. Furthermore, the provision of the elongated lateral registration edge serves to impart friction forces to the sheet being aligned, and as a result may adversely impact the overall registration function of the registration apparatus.

SUMMARY OF THE INVENTION

In view of the foregoing discussion, this invention is directed to a sheet transport apparatus, for transporting sheets along a travel path, including a registration mechanism for rapidly and accurately effecting edge registration of a transported sheet. The registration mechanism comprises a support for a sheet moving along the travel path and a pair of frusto-conical rollers. The frusto-conical rollers are mounted for rotation about a common axis, with the apex portions of the respective frusto-conical rollers oriented in the same direction relative to the common axis. The common axis is located to lie in a plane parallel to the plane of a sheet in the travel path and extend in a direction transverse to the direction of movement of a sheet along the travel path. The plane containing the axis is spaced from the sheet supporting means a distance such that the frusto-conical rollers are in nip relation with the sheet supporting means so as to urge a sheet in the travel path in the direction of movement along the travel path and in a direction transverse to the direction of movement with a minimum of skew induced in such sheet.

The invention, and its objects and advantages, will become more apparent in the detailed description of the preferred embodiment present below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figures 1, 5:
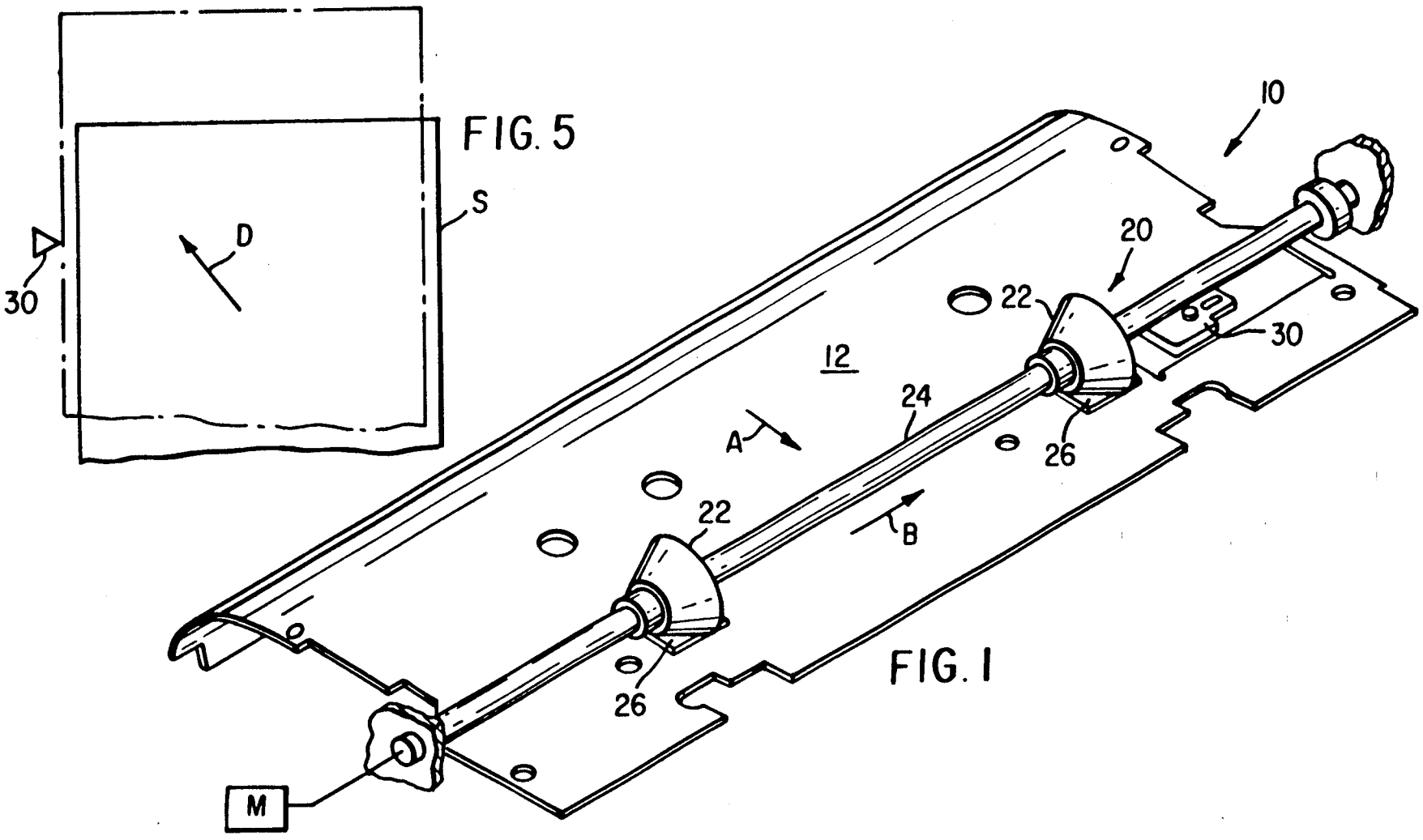
FIG. 1 is a view, in perspective, of the transport apparatus and registration mechanism according to this invention.
FIG. 5 is a simplified top plan view showing the movement of a sheet as it is transported and registered by the transport apparatus and registration mechanism according to this invention.
Figure 2:
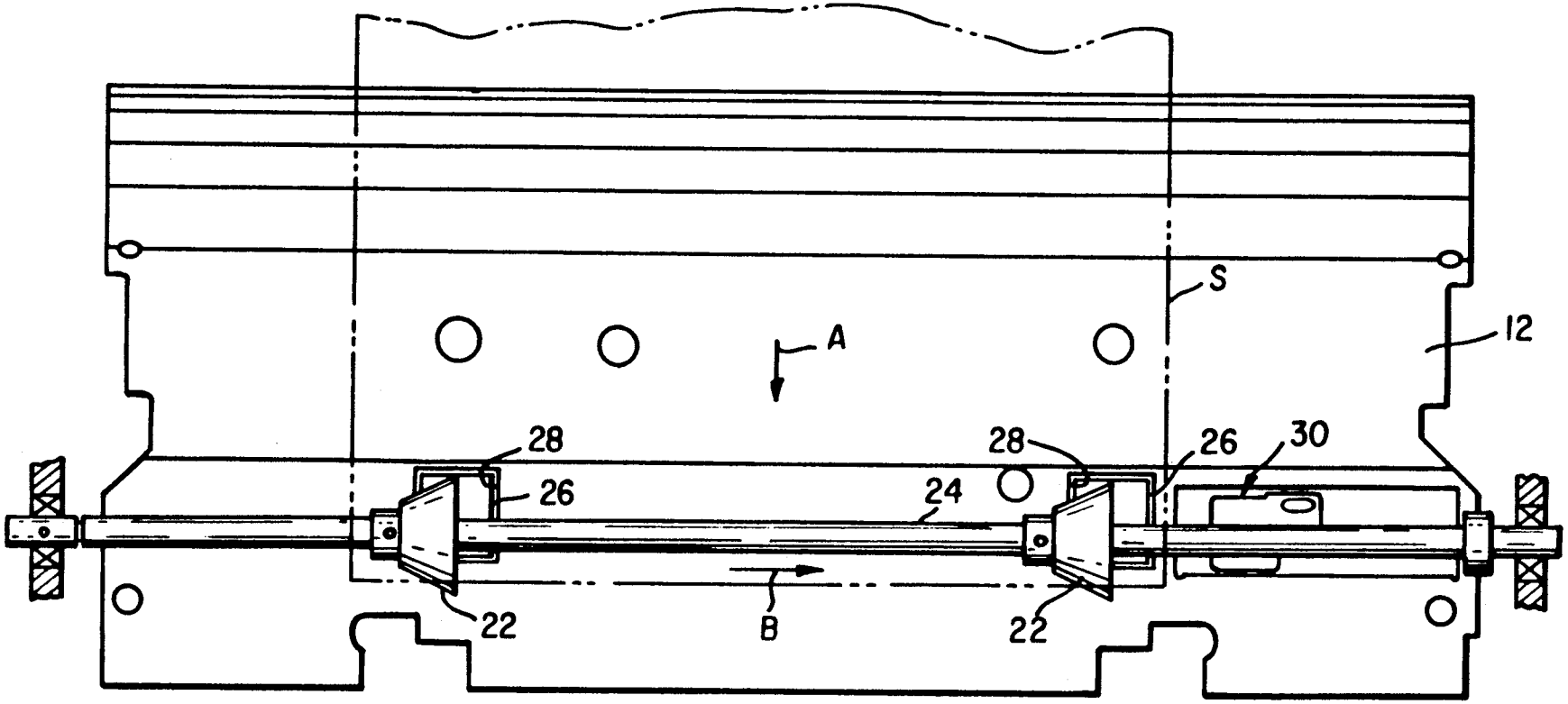
FIG. 2 is a top plan view of the transport apparatus and registration mechanism of FIG. 1, with a sheet to be transported and registered shown in phantom.

Referring now to the accompanying drawings, FIGS. 1 and 2 best show a sheet transport apparatus, designated generally by the numeral 10, including the registration mechanism 20 according to this invention. The sheet transport apparatus 10 includes a guide plate 12 defining a substantially planar travel path for sheets, for example cut sheets of receiver material for use in reproduction apparatus. The sheets are urged along the travel path seriatim in the general direction indicated by arrow A, for example by an upstream transport mechanism such as driven nip rollers (not shown).

The registration mechanism 20, according to this invention, is provided for urging transported sheets of receiver material along the travel path in the direction of arrow A and in a direction indicated by arrow B transverse to the first mentioned direction so as to register the sheets in the cross-track direction, relative to the travel path, against a registration member 30. Such cross-track registration action assures that a sheet is accurately positioned relative to any well known process station (not shown), located downstream of the transport apparatus 10, for transportation thereto.

The registration mechanism 20 includes a pair of frusto-conical rollers 22 fixed on a shaft 24. The shaft 24, which is mounted for rotation about its longitudinal axis, is coupled to a motor M for imparting rotation to the shaft (and thus the frusto-conical rollers) when the motor is activated. Of course it is also suitable for this invention that the rollers 22 be mounted on independent rotatable shafts having common rotational axis. The frusto-conical rollers 22 are formed of a high friction material such as a high friction silicone for example. The orientation of the frusto-conical rollers is selected, for the reasons to be explained below, such that the apex portions of the respective rollers are oriented in the same direction relative to the longitudinal axis of the shaft 24.

The shaft 24 is located relative to the guide plate 12 such that the longitudinal axis of the shaft lies in a plane parallel to the plane of a sheet urged along the travel path in the direction A, and extends in a direction transverse to the direction of movement of the sheet urged along the travel path. The plane containing the shaft 24 is spaced from the guide plate 12 a distance such that the pair of frusto-conical rollers 22 are in nip relation with a pair of spring loaded pressure plates 26 respectively. The pressure plates 26 are connected to the guide plate 12 and extend into respective openings 28 defined in the guide plate to operatively communicate with the frusto-conical rollers.

Figure 4:
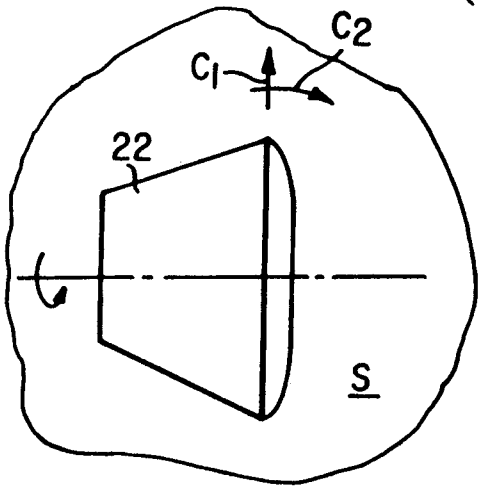
FIG. 4 is a simplified view of one of the frusto-conical rollers of the registration mechanism of FIG. 1.

As is well known, urging of a sheet of receiver material along a travel path by a rotating frusto-conical roller induces a compound movement in the sheet. As shown in FIG. 4, such compound movement of a sheet (designated by the letter S) has a first component $C_1$ in a direction perpendicular to the rotational axis of the frusto-conical roller, and a second component $C_2$ in a direction which amounts to rotation of the sheet about a pivot point in space along the axis of rotation of the frusto-conical roller. This results in both rotation (skewing) of the sheet and shifting of the sheet transverse to the direction of movement along the travel path as the sheet moves in the direction of the first component $C_1$. However, it has been discovered that, according to this invention, the provision of a pair of similarly oriented frusto-conical rollers, spaced apart a substantial distance (as shown in FIGS. 1 and 2), rotating about a common axis transverse to the desired direction of movement of a sheet along a travel path results in the pivot point for rotation of the sheet being located substantially at an infinite distance from the frusto-conical rollers.

Thus, when the frusto-conical rollers 22 are rotated by rotation of the shaft 24, the nip relation between the pair of frusto-conical rollers and the respective pair of pressure plates 26 results in a sheet entering such nip being moved in a direction which lies along a line designated by the letter D (see FIG. 5). The sheet movement direction D represents the sum of the components of movement of a sheet in the directions A and B. Accordingly, the sheet moves in the direction D without any rotation (skewing). Therefore, the need to provide additional mechanisms to correct for skewing of the sheet (and any additional time to accomplish such correction) is eliminated.

Figure 3:
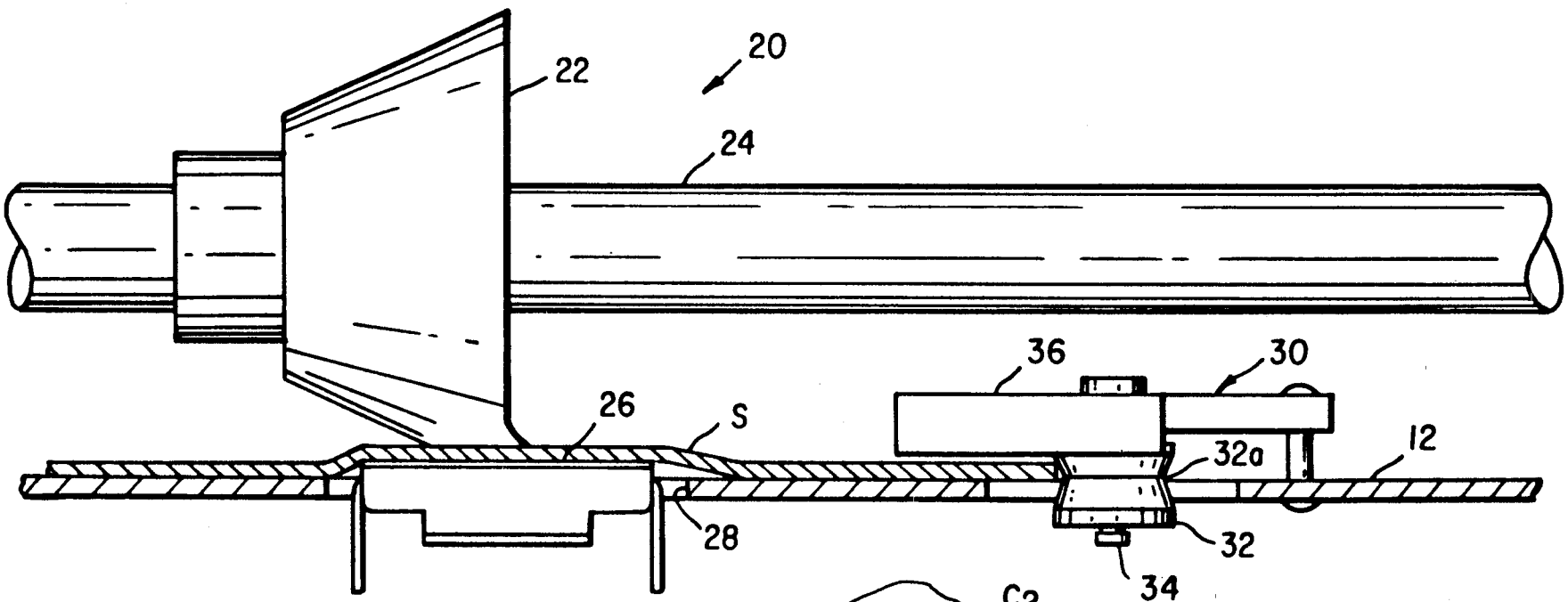
FIG. 3 is an end elevational view of a portion of the transport apparatus and registration mechanism of FIG. 1, with portions removed or broken away to facilitate viewing.

The rotating frusto-conical rollers 24 continue to urge a sheet in the directions along and transverse to the travel path until a lateral edge of such sheet engages the cross-track registration member 30. The registration member 30 includes a spool roller 32. The spool roller 32 is mounted on a shaft 34 for free rotation about the longitudinal axis of the shaft. The shaft 34 is supported on a frame 36 connected to the guide plate 12. As best shown in FIG. 3, the frame 36 locates the shaft 34 (and thus the spool roller 32) such that the longitudinal axis of such shaft to lie in a plane including the longitudinal axis of the shaft 24, and the apex 32*a* of the spool roller lies in a plane substantially coincident the plane of a sheet (designated by the letter S) urged along the travel path. Further, the line through the point of tangency on the circumference of the apex 32*a*, where it is engaged by a sheet, is coincident with a line representing desired accurate registration relative to the downstream process station. The spool roller 32 presents a point contact to the lateral edge of the sheet being registered and acts as a frictionless rolling element to such lateral edge. Accordingly, with a sheet accurately registered in the cross-track direction at the apex 32*a* of the spool roller 32, as such sheet is further urged along the travel path, the spool roller provides substantially no drag component to the sheet. Therefore, any tendency of the lateral edge registering member 30 to induce skew in the registered transported sheet is prevented.

The invention has been described in detail with particular reference to preferred embodiment thereof, but it will be understood that variations and modifications can be effected within the spirit and scope of the invention as set forth in the claims.

What is claimed is:

1. In an apparatus for transporting sheets along a travel path, a registration mechanism for accurately aligning a sheet in the direction transverse to said travel path, said registration mechanism comprising:

means for supporting a sheet moving along said travel path;

a rotatable drive shaft;

means for rotating said drive shaft about its longitudinal axis;

a pair of frusto-conical rollers;

means for mounting said frusto-conical rollers, spaced apart a distance, on said drive shaft, with the apex portions of the respective frusto-conical rollers oriented in the same direction relative to said longitudinal axis of said drive shaft;

means for locating said drive shaft in a plane parallel to the plane of a sheet in said travel path and extending in a direction transverse to the direction of movement of a sheet along said travel path, said plane containing said drive shaft being spaced from said sheet supporting means a distance such that said frusto-conical rollers are in nip relation with said sheet supporting means so as to urge a sheet in said travel path in the direction of movement along said travel path, in a direction transverse to said direction of movement, and about a pivot point for rotation of the sheet, said pivot point being located substantially at an infinite distance from said frusto-conical rollers; and means for providing a lone lateral edge registration point for a sheet transported under the urging of said frusto-conical rollers in said travel path in the direction of movement along said travel path and in a direction transverse to said direction of movement, said registration point lying in a plane including the longitudinal axis of said rotatable drive shaft;

whereby a minimum of skew is induced in such sheet.

2. The registration mechanism of claim 1 wherein said lateral edge registration point providing means includes a roller, and means for mounting said last mentioned roller so as to have the circumference thereof engageable by the edge of a sheet being registered thereagainst, and so as to enable said roller to substantially freely rotate about its longitudinal axis.

* * * * *